US008152664B2

(12) United States Patent
Madore et al.

(10) Patent No.: US 8,152,664 B2
(45) Date of Patent: Apr. 10, 2012

(54) FOOTBALL WITH INFLATABLE BLADDER HAVING INTEGRAL GRIP AREAS

(75) Inventors: Carl L. Madore, Portland, OR (US); Ian R. Lindsey, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 186 days.

(21) Appl. No.: 12/647,752

(22) Filed: Dec. 28, 2009

(65) Prior Publication Data

US 2010/0099521 A1 Apr. 22, 2010

Related U.S. Application Data

(63) Continuation of application No. 11/625,536, filed on Jan. 22, 2007, now abandoned.

(51) Int. Cl.
*A63B 41/00* (2006.01)

(52) U.S. Cl. ..... 473/596; 473/603

(58) Field of Classification Search ..... 473/595, 473/596, 597, 603–605, 609, 593; 446/183, 446/185, 197, 198

See application file for complete search history.

(56) References Cited

U.S. PATENT DOCUMENTS 1,649,458 A * 11/1927 Fewlass ..... 473/597
1,931,429 A 10/1933 Buckner et al.
2,011,760 A 8/1935 Gallinant
2,194,674 A 3/1940 Riddell
2,931,653 A 4/1960 Gow et al.
3,256,019 A * 6/1966 Barton ..... 473/597
3,887,416 A 6/1975 Tebbetts, Jr.
D235,794 S 7/1975 Kroener
4,736,948 A 4/1988 Thomas
4,772,020 A 9/1988 Martin
4,887,814 A 12/1989 Winter
RE33,449 E 11/1990 Martin
5,133,550 A 7/1992 Handy
5,253,866 A 10/1993 Moorman et al.
D354,102 S 1/1995 Lehman
5,383,660 A 1/1995 Adler et al.
D355,685 S 2/1995 Ross
5,451,046 A 9/1995 Batton
5,522,757 A 6/1996 Ostrowski
D375,129 S 10/1996 Daicos
5,577,724 A 11/1996 Gandolfo
5,681,233 A 10/1997 Guenther et al.
5,921,840 A * 7/1999 Diresta et al. ..... 446/198
5,931,752 A 8/1999 Guenther et al.

(Continued)

OTHER PUBLICATIONS

International Search Report mailed Jul. 7, 2008 from related PCT Application No. PCT/US2008/051594.

*Primary Examiner* — Steven Wong
(74) *Attorney, Agent, or Firm* — Plumsea Law Group, LLC

(57) ABSTRACT

A football comprising an inflatable bladder integrally molded with raised areas which are intended to be exposed, and exterior panels which are adhered to the bladder to span the spaces between them. The raised areas or ridges are formed to extend outward from the exterior panels and provide a raised grip area. By bonding the exterior panels to the bladder directly, stitching and lacing are eliminated to simplify construction and manufacture. The football is provided with a plurality of raised areas to provide more grip areas than the single lace area of a traditional football. Each of the raised ridges are contoured to more closely follow the shape of a thrower's hand as it grasps the ball and thereby providing greater contact area and better control.

15 Claims, 6 Drawing Sheets

U.S. PATENT DOCUMENTS

| | | | |
|---|---|---|---|
| 5,984,812 | A | 11/1999 | Sassak |
| 6,099,423 | A | 8/2000 | Ou |
| 6,123,633 | A | 9/2000 | Guenther et al. |
| D453,036 | S | 1/2002 | Frisina et al. |
| D453,037 | S | 1/2002 | Frisina et al. |
| D453,201 | S | 1/2002 | Frisina et al. |
| D453,202 | S | 1/2002 | Frisina et al. |
| 6,520,877 | B1 | 2/2003 | Yang |
| 6,592,477 | B1 | 7/2003 | Yang |
| 6,612,948 | B1 | 9/2003 | Miller |
| 6,634,970 | B2 | 10/2003 | Jiminez |
| D497,655 | S | 10/2004 | Frisina |
| D498,802 | S | 11/2004 | Chang |
| D503,760 | S | 4/2005 | Chang |
| D504,709 | S | 5/2005 | Chang |
| D518,536 | S | 4/2006 | Chang |
| 7,029,407 | B2 | 4/2006 | Lee et al. |
| D520,578 | S | 5/2006 | Chen |
| 7,037,224 | B1 | 5/2006 | Page et al. |
| 7,264,533 | B2 | 9/2007 | Chan et al. |
| 2005/0079936 | A1 | 4/2005 | Litchfield |
| 2005/0245335 | A1 | 11/2005 | Frisina |
| 2006/0105866 | A1 | 5/2006 | Ma |
| 2006/0205544 | A1 | 9/2006 | Wyner et al. |
| 2007/0072712 | A1 | 3/2007 | Chernick et al. |
| 2007/0178997 | A1 | 8/2007 | Chang |

* cited by examiner

FOOTBALL WITH INFLATABLE BLADDER HAVING INTEGRAL GRIP AREAS

BACKGROUND OF THE INVENTION

1. Field of the Invention

The present invention relates to a football with multiple contoured grip areas for greater contact and better control when the ball is thrown.

2. Background of the Invention

Most inflatable sports balls are made by one of two main constructions: a traditional construction in which an inner bladder is surrounded by outer panels stitched together to contain the inflated bladder; and a carcass construction in which outer panels are laminated to an inner bladder. Examples of balls of traditional construction include some soccer balls, volleyballs and footballs which have pieced and stitched outer panels. An example of a ball of carcass construction is a basketball which has an integral outer cover.

Conventional footballs are constructed in the traditional way by surrounding an inner bladder with an outer skin formed of multiple panels stitched together. In traditional construction, the bladder is inserted into an opening in the outer skin, and the outer skin is laced together to close the opening. The lacing is raised and extends some distance along the length of the football. The laces serve another function as well. When throwing the ball, a thrower generally grips the ball with the fingers along the laces. The lacing enhances the grip on the ball and provides a locus for imparting a spiral motion to the ball as it leaves the thrower's hand to thereby enhance the flight of the ball.

This traditional design is still used today even though modern manufacturing methods and materials do not necessarily require lacing together of the outer skin. In some footballs, laces or lace-like structures are molded onto the surface of the ball even if they are not necessary for construction. The laces are still a reference point for a thrower and the locus for the initiation of a spiral motion. An example of a lace-like element is disclosed in U.S. Pat. No. 5,383,660 to Adler et al. in which an elongated indentation array is provided on the surface. Even though the football of Adler et al. does not use lacing for construction purposes, the indentation array is provided on the surface in an area that mimics the location of traditional laces.

An attempt to minimize accidental slippage of a traditional laced football is disclosed in U.S. Pat. No. 1,931,429 to Buckner et al. in which the football is provided with spiral grooves extending along the surface of the leather. The grooves terminate short of the pointed ends of the ball. The grooves are filled with an abrasive substance with an adhesive to provide an overall anti-slip cover to the ball to avoid accidental fumbling and minimize error during play.

One category of prior art footballs eliminated the laces and used spiral seams to stitch together the panels of the outer skin. Examples of spiral seamed footballs without laces are disclosed in U.S. Design Pat. No. D235,794 to Kroener, and U.S. Pat. No. 2,194,674 to Riddell. The Riddell patent also discloses fin-like surface ridges that coincide with the seams. The spiral ridges are thin and circular or semi-circular in cross-section, and formed by covering an upstanding seam with latex, by applying cords to the surface of the carcass prior to covering with leather, or by stitching a separately formed cord or bead strip to the exterior of the football.

Another category of prior art footballs which departed from the conventional laced construction eliminated the bladder altogether. Solid resilient foam footballs with externally molded helical finger grooves or channels are disclosed in U.S. Pat. No. 4,887,814 to Winter and U.S. Pat. Nos. Re. 33,449 and 4,772,020 to Martin. Because of their elastic foam construction, these footballs do not provide the same heft and feel of traditional footballs.

While the prior art contains numerous attempts to improve ball handling, most still rely primarily on the laces or a lace-like area of the football to provide a grip area. The prior footballs that use spiral grooves or ridges are either formed from a solid resilient foam material or require the use of extra materials in addition to the bladder and covering. None have addressed the need for a football having the same heft and feel as a traditional laced football, but also having improved gripping areas for a thrower to grasp the ball and thereby provide better control and enhanced ball flight.

SUMMARY

The football of the present invention does not easily fall into the traditional construction category, or the carcass construction category. That is, the construction of the present invention is neither the traditional pieced and stitched outer panels nor an integral outer laminated covering. Instead, the football of the present invention comprises an inflatable bladder integrally molded with raised areas which are intended to be exposed, and exterior panels which are adhered to the bladder to span the spaces between them. The raised areas are formed to extend outward from the exterior panels and provide a raised ridge and grip area. By bonding the exterior panels to the bladder directly, stitching and lacing are eliminated, thereby considerably simplifying the construction and manufacturing process. Moreover, the football of the present invention is provided with a plurality of raised ridges to provide more grip areas than the single lace area of a traditional football. Each of the raised ridges are contoured to more closely follow the shape of a thrower's hand as it grasps the ball and thereby providing greater contact area and better control.

It is therefore an object of the invention to provide a football of simplified construction as compared with a traditional laced football.

It is an object of the invention to provide an inflatable bladder football with raised grip areas integral with the bladder to simplify manufacture while maintaining the heft and feel of a traditional football.

It is another object of the invention to provide a football with multiple grip areas to improve a thrower's chances of optimally gripping the ball.

It is yet another object of the invention to provide a football with a contoured grip area to more closely follow the shape of a thrower's hand as it grasps the ball.

It is another object of the invention to provide a football with contoured raised areas that enhance ball flight particularly in spiral motion to cause the ball to fly truer and farther.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views. In the drawings.

DETAILED DESCRIPTION

Figure 1:
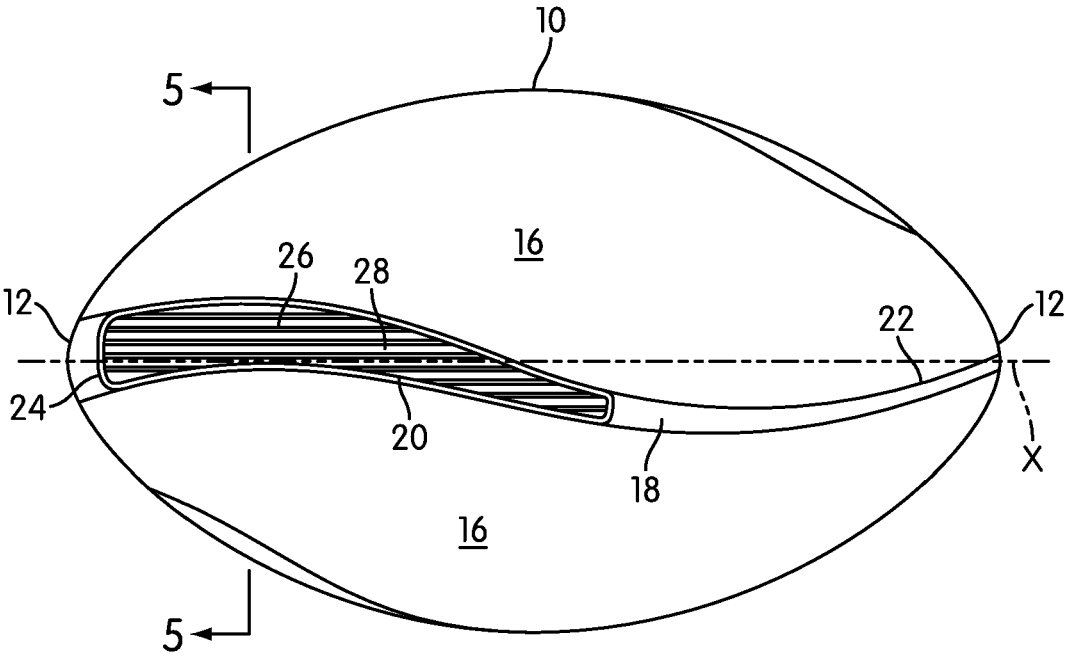
FIG. 1 is a side elevational view of one side of a football in accordance with the present invention.
Figure 2:
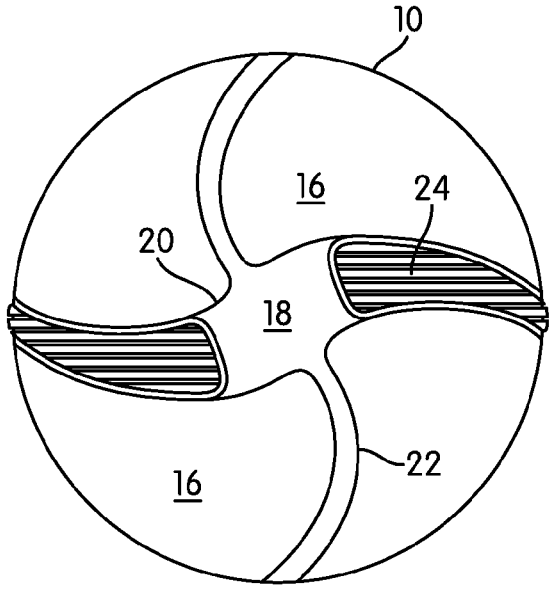
FIG. 2 is an end elevational view of the left end of the football as oriented in FIG. 1.
Figure 3:
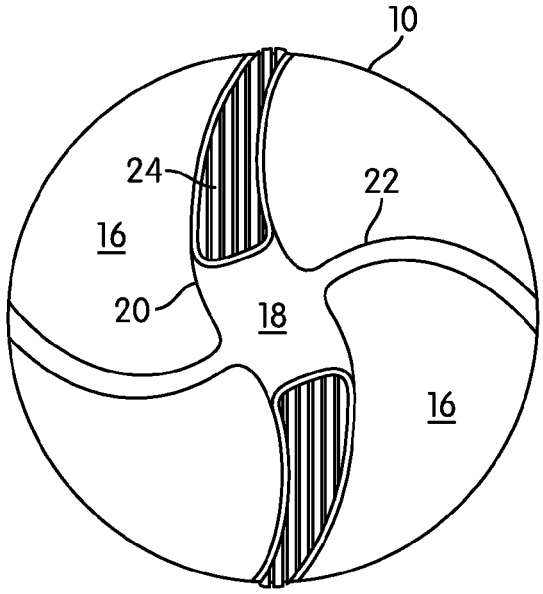
FIG. 3 is an end elevational view of the right end of the football as oriented in FIG. 1.
Figure 4:
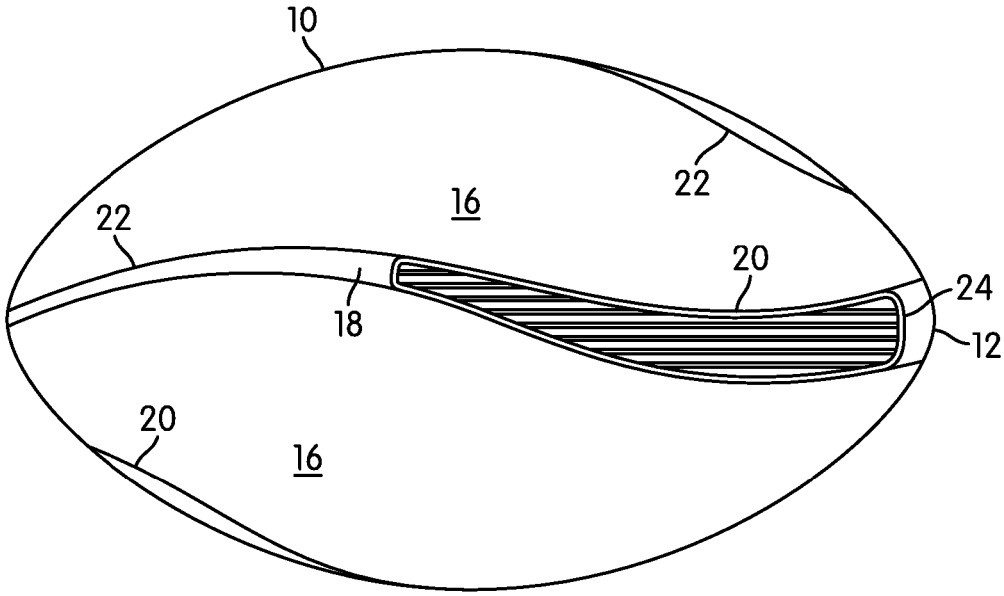
FIG. 4 is a side elevational view of the opposite side of the football as oriented in FIG. 1.

Referring to the figures, football 10 has a body with opposing ends 12 through which longitudinal axis X extends. The body has a circular cross-section whose diameter increases from an end point to a maximum diameter midway along the longitudinal axis X to resemble a prolate spheroid. Football 10 is comprised of an inflatable bladder 14 and exterior panels 16. Inflatable bladder 14 gives the body of the football its shape, and is exposed at ends 12, and also includes exposed areas 18 extending longitudinally along the body. Each exposed area 18 is in communication to the exposed ends. Exterior panels 16 are islands extending between exposed areas and exposed ends. Each exposed area 18 of bladder 12 is an integrally molded raised ridge with a relatively wider grip area 20 and a narrower portion 22.

Figure 5:
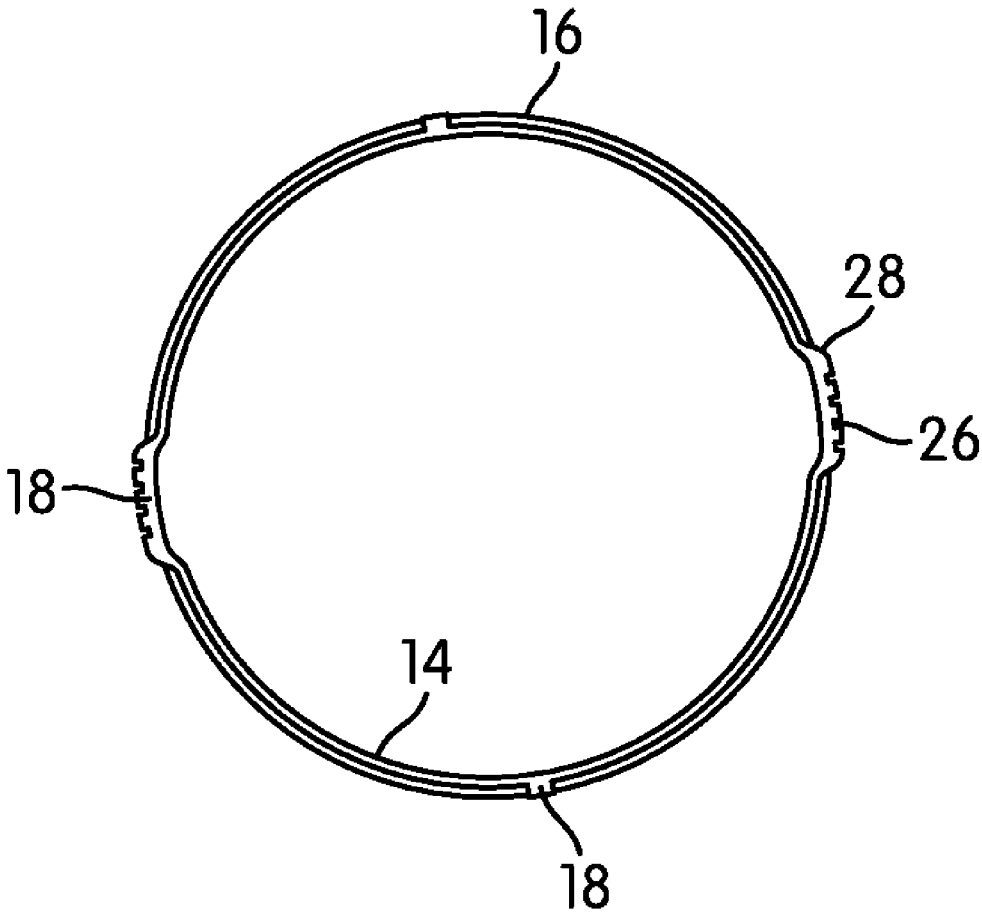
FIG. 5 is a cross-section taken along line 5-5 of FIG. 1.
Figure 6:
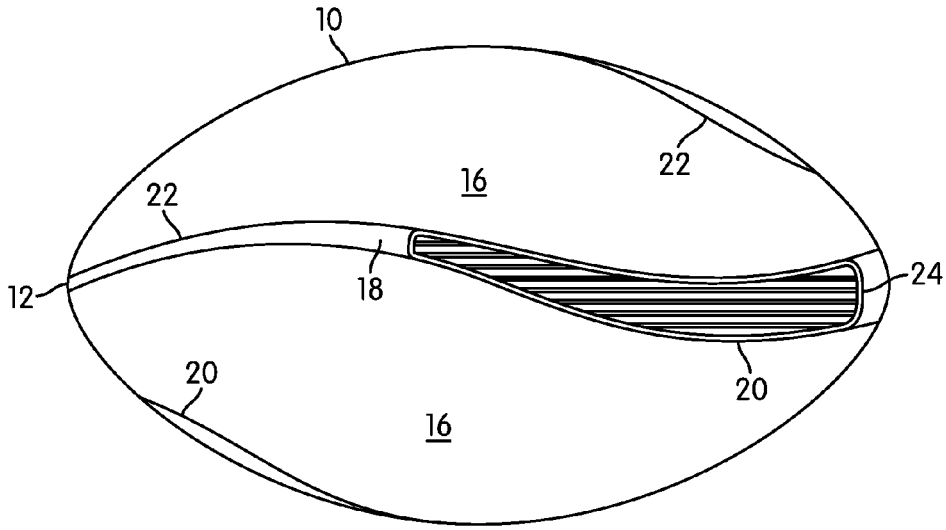
FIG. 6 is a top plan view of the football as oriented in FIG. 1.
Figure 7:
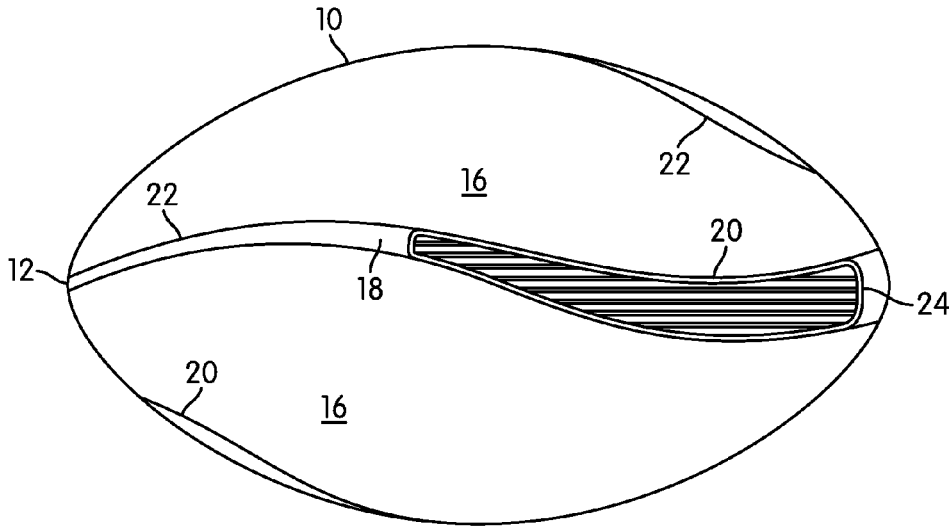
FIG. 7 is a bottom plan view of the football as oriented in FIG. 1.

Exposed portion 18 has a shape that is contoured in two ways: first, it smoothly transitions between wider grip area 20 and narrow portion 22; and second, exposed portion 18 has an S-shape as it traverses longitudinally along the surface of the football. Grip area 20 has a textured surface to enhance grip. In the embodiment shown in the drawings, the texture comprises a textured area 24 containing a series of parallel grooves 26 that form parallel ribs 28. In the illustrated embodiment the grooves and ribs extend generally in the longitudinal direction of the football. As best seen in FIG. 5, raised grip area 20 preferably extends 2.5 millimeters above the exterior panel of the football. This height is similar to the height of the laces on a conventional football, and would feel familiar to most players. Also referring to FIG. 5, grooves 26 within the raised grip area 20 are generally about 1.0 millimeters which has been found to be a good dimension to provide a tactile grip. This dimension could be adjusted if deemed necessary to adjust tactility.

Textured area 24 could contain grooves and ribs extending in a different direction, or an alternative texture such as projections or curvilinear grooves. Any type of texture is within the purview of the invention. Examples of alternative textures include bumps, projections, raised or sunken letters, numbers, other indicia, graphics, logos, and the like.

As best viewed from the ends, the illustrated embodiment of the football comprises four exposed areas 18 spaced approximately 90° from one another around the circumference of the football. The contoured exposed areas 18 merge at each end 12 of the football, FIGS. 2 and 3. These are arranged so that at each end two exposed areas with their wider portions 20 are in opposing relation, and two exposed areas with their narrower portions 22 are also in opposing relation. In this manner, as viewed from an end the merged exposed area comprises a wide portion 20 arranged approximately 90° from a narrow portion 22 in alternating fashion. Also, the contoured shapes of the merged exposed areas resemble vanes of a propeller or the like. That is, the exposed areas contour so that their curves correspond with one another and appear as if they could nest when viewed from the ends of the football. The relation of the raised and exposed areas to on another is illustrated in FIGS. 2-7 by showing the raised and exposed areas on the opposite side of the football in broken lines.

Raised and exposed areas 18 provide tactile reference points for a thrower's finger. With multiple grip areas, the football of the present invention provides four different grip areas for a thrower's finger. This is in contrast to a single grip area, the laces, on a traditional football. The multiplicity of grip areas helps ensure that a thrower is able to grip the ball quickly and securely, and thereby throw a greater distance and/or with better accuracy. If the throw imparts a spiral motion to the football, the gentle wave-like contouring of the raised and exposed areas also serve to enhance the flight of the ball. Furthermore, the curved orientation of the grip areas more closely mirrors the shape of a thrower's hand as it rests on the ball in comparison to the straight orientation of the laces on a conventional football. The contoured grip area therefore provides an increased contact area and better control when the ball is thrown.

Bladder 14 is integrally formed with raised, exposed areas 18, and the detailed structure thereof can also be integrally molded thereto. For example, the bladder may be molded with the specific texture on the grip areas as shown in the drawings. After the bladder is formed by molding, for example, exterior panels 16 are bonded to the areas between the raised exposed areas 18. In the embodiment shown in FIGS. 1-7, there are four exterior panels 16, and they do not converge at the ends since the raised bladder portions merge at the ends. Exterior panels 16 are bonded to the bladder by any means, heat bonding, adhesives, laminating, and the like. After the exterior panels are bonded to the bladder, the bladder is inflated through a valve (not shown) which may be of any known construction.

The bladder is made of a rubber compound that provides the moldability for forming the grip portions, and the durability necessary for leaving portions of the bladder exposed. An example of a rubber compound that can be used is 50% butyl synthetic rubber and 50% natural rubber. Exterior panels 16 can be made of any material such as leather or synthetic leather. An example of a synthetic material that could be used for exterior panels 16 is polyurethane composite leather.

The construction of the ball of the present application is greatly simplified as compared to traditionally constructed laced footballs. Manufacturing is speedier and less costly for a ball with the integrally formed and exposed bladder and bonded exterior panels.

Figure 8:
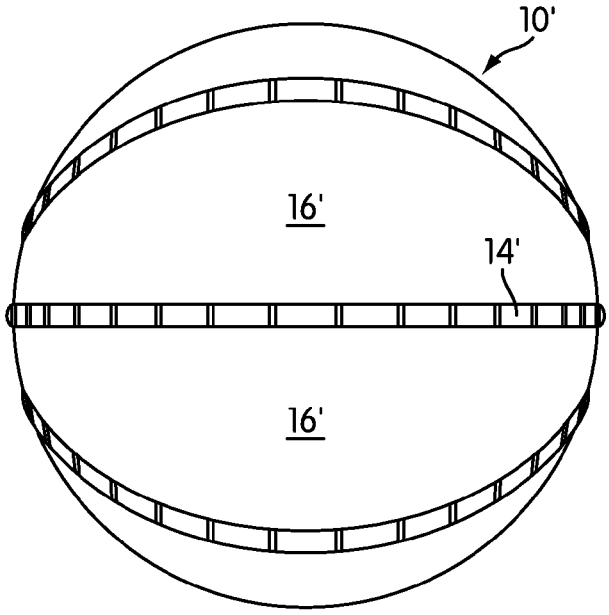
FIG. 8 is a front elevational view of a round ball embodiment of the present invention.
Figure 9:
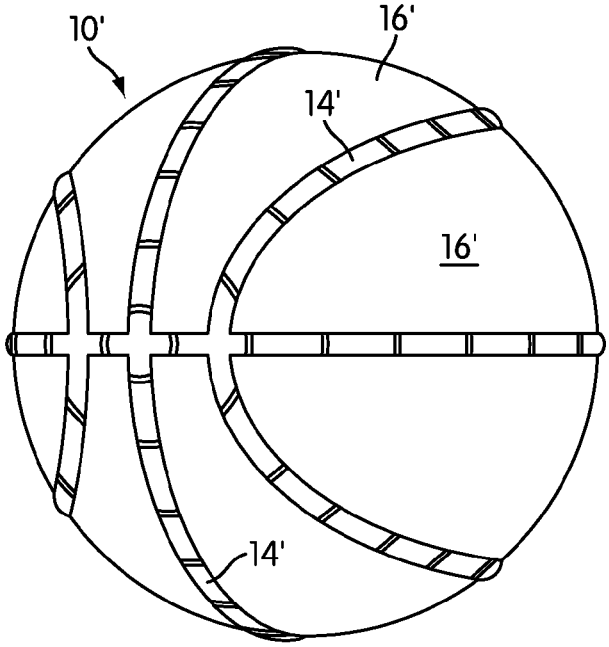
FIG. 9 is a perspective view of the ball of FIG. 8.

Another embodiment of the present invention is the application of the inventive concept to a round ball. A round ball 10' is shown in FIGS. 8-9 with an integrally molded bladder 14' and exterior panels 16' spanning the areas between the exposed areas 18' of the bladder. The exposed areas of ball 18' are shown as only slight raised from the spheroid surface and with a ribbed texture. As with the previous embodiments, any type of texture could be employed on the exposed portions of the bladder to enhance the grip of the ball and the tactile feedback it provides to a user or player. A round ball with the textured grip areas could be used for any activity in which a secure grip would pose an advantage. Examples of such activities include water polo, hand ball or basketball.

While various embodiments of the invention have been described, it will be apparent to those of ordinary skill in the art that may more embodiments and implementations are possible that are within the scope of the invention.

What is claimed is:

1. A football having a longitudinal axis extending between opposite ends, of circular cross-section with a minimum diameter at each of the ends, the diameter of the circular cross-section increasing gradually to a maximum diameter midway between the ends, said football comprising:

an inflatable bladder having an outer skin;

an exterior panel overlaying and bonded to said bladder except at an exposed portion of said outer skin;

wherein the exposed portion includes a grip area that is thicker than a thickness of a remaining portion of the outer skin;

wherein said grip area is at least flush with said exterior panel;

wherein at least a portion of said grip area is textured;

wherein said exposed portion is contoured to curve along said football in an S-shape; and wherein said exposed portion is widest at a first one of the longitudinal opposite ends and narrowest at a second one of the opposite ends with a smoothly contoured transition between the first one and the second one of the opposite ends.

2. The football of claim 1, wherein said grip area is raised beyond said exterior panel.

3. The football of claim 1, wherein said bladder has at least two exposed portions each having a grip area.

4. The football of claim 3, wherein each grip area is raised to be at least flush with said exterior panel.

5. The football of claim 4, wherein grip area is raised beyond said exterior panel.

6. The football of claim 5, wherein at least a portion of each grip area is textured.

7. The football of claim 6, wherein said exposed portions extend generally longitudinally along said football.

8. The football of claim 7, wherein each exposed portion curves along said football in an S-shape.

9. The football of claim 8, wherein a first exposed portion is widest at a first one of the longitudinal opposite ends and narrowest at a second one of the opposite ends; and wherein a second exposed portion is widest at the second one of the opposite ends and narrowest at the first one of the opposite ends.

10. The football of claim 9, wherein the first exposed portion and the second exposed portion each include the first one of the opposite ends and the second one of the opposite ends.

11. A football having a longitudinal axis extending between opposite ends, of circular cross-section with a minimum diameter at each of the ends, the diameter of the circular cross-section increasing gradually to a maximum diameter midway between the ends, said football comprising:

an inflatable bladder having a plurality of exposed portions extending longitudinally along said football, each said exposed portion including a grip area;

exterior panels overlaying and attached to said bladder between said exposed portions;

wherein the grip area is raised to be at least flush with said exterior panels, at least a portion of the raised grip area being textured;

wherein each said exposed portion is widest at a first one of the longitudinal opposite ends and narrowest at a second one of the opposite ends;

wherein the grip area is disposed at the first one of the longitudinal opposite ends where said exposed portion is widest; and wherein the textured portion of the raised grip area extends along less than the entirety of said exposed portion.

12. The football of claim 11, wherein said exposed portions curve along said football.

13. The football of claim 12, wherein each said exposed portion has a smoothly contoured transition between the first one and the second one of the opposite ends.

14. The football of claim 13, wherein said exposed portions each include the first one of the opposite ends and the second one of the opposite ends.

15. The football of claim 14, wherein said exposed portions are spaced 90° from one another with respect to the longitudinal axis.

* * * * *